12/4/84 XR 4,486,167

United States Patent [19]

McMurray et al.

[11] Patent Number: 4,486,167

[45] Date of Patent: Dec. 4, 1984

[54] FLARE HAVING NOISE ATTENUATION

[75] Inventors: Robert McMurray, Ashford; Gerald Pratley, Hampton, both of England

[73] Assignee: The British Petroleum Company Limited, London, England

[21] Appl. No.: 326,287

[22] Filed: Dec. 1, 1981

[30] Foreign Application Priority Data

Dec. 10, 1980 [GB] United Kingdom ..... 8039568

[51] Int. Cl.[3] ..... F23D 21/00

[52] U.S. Cl. ..... 431/114; 431/202; 431/350; 239/288; 239/424; 239/DIG. 7; 181/198; 181/229

[58] Field of Search ..... 431/202, 114, 284, 350; 239/DIG. 7, 265.13, 288, 424; 181/198, 205, 210, 229

[56] References Cited

U.S. PATENT DOCUMENTS

| | | | |
|---|---|---|---|
| 2,061,561 | 11/1936 | Cartter | 431/114 |
| 2,450,205 | 9/1948 | Rose | 222/193 |
| 3,565,208 | 2/1971 | Millman et al. | 239/265.13 X |
| 3,720,497 | 3/1973 | Arenson | 431/114 |
| 3,779,689 | 12/1973 | Reed et al. | 431/89 |
| 3,791,940 | 2/1974 | Alexander | 204/35 N |
| 3,794,137 | 2/1974 | Teodorescu et al. | 239/DIG. 7 |
| 3,819,319 | 6/1974 | Schreter | 431/5 |
| 3,840,320 | 10/1974 | Desty et al. | 431/4 |
| 3,840,326 | 10/1974 | Schreter | 431/114 |
| 3,859,033 | 1/1975 | Buchanan et al. | 431/5 |
| 3,868,210 | 2/1975 | Simpson et al. | 431/4 |
| 3,887,324 | 6/1975 | Reed et al. | 431/5 |
| 3,932,111 | 1/1976 | Liknes et al. | 431/202 |
| 3,994,671 | 11/1976 | Straitz | 431/202 |
| 3,995,986 | 12/1976 | Straitz | 431/114 |
| 4,003,693 | 1/1977 | Straitz | 431/202 |
| 4,039,276 | 8/1977 | Reed et al. | 431/202 |
| 4,092,095 | 5/1978 | Straitz | 431/114 |
| 4,099,908 | 7/1978 | Beckmann et al. | 431/284 |

FOREIGN PATENT DOCUMENTS

| | | | |
|---|---|---|---|
| 815271 | 7/1937 | France | 181/210 |
| 52-44323 | 4/1977 | Japan | 181/229 |
| 1249967 | 10/1971 | United Kingdom | 431/202 |
| 1475959 | 6/1977 | United Kingdom . | |
| 2002895 | 2/1979 | United Kingdom . | |
| 2004637 | 4/1979 | United Kingdom . | |
| 568792 | 8/1977 | U.S.S.R. . | |

*Primary Examiner*—Samuel Scott
*Assistant Examiner*—Allen J. Flanigan
*Attorney, Agent, or Firm*—Morgan, Finnegan, Pine, Foley & Lee

[57] ABSTRACT

A high pressure gas flare using the Coanda effect has a noise attenuator surrounding the high pressure gas outlet slot. The noise attenuator is in the form of one or more upwardly diverging frusto-conical shields which may be spaced apart or closed with the body of the flare. The attenuator is particularly useful for steam driven flares.

13 Claims, 4 Drawing Figures

FLARE HAVING NOISE ATTENUATION

Figure 1:
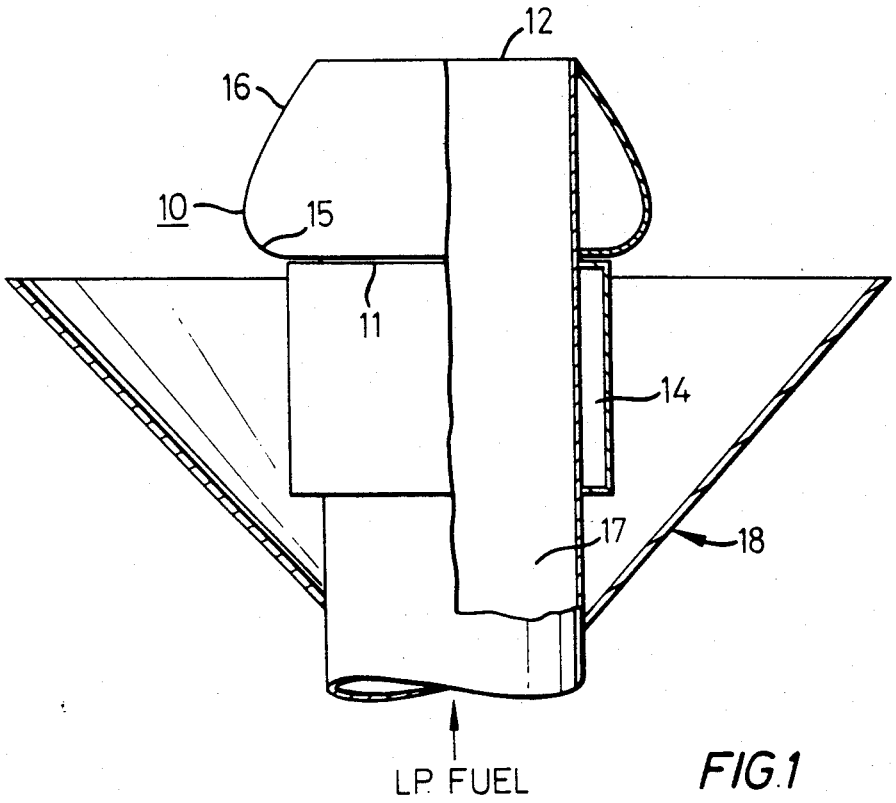

The present invention relates to flares and more particularly to means for reducing the noise emitted by flares during operation.

During flaring of combustible gases, for example, during emergency procedures, a considerable amount of acoustic energy may be released, particularly when using high pressure gas sources. For example, this is the case when operating flares, including Coanda flares, with a high pressure steam supply.

It is known that when the extension of one lip of the mouth of a slot through which a fluid emerges under pressure, progressively diverges from the axis of the slot, the stream of fluid emerging through the slot tends to stick to the extended lip thus creating a pressure drop in the surrounding fluid thus causing fluid flow towards the low pressure region. This physical phenomenon is known as the Coanda effect and a body exhibiting this effect is known as a Coanda body. The Coanda body usually is of (a) the internal venturi-shaped type in which the pressurised fluid emerges from an orifice near the throat of the venturi and passes towards the mouth or (b) the external type in which the pressurised fluid emerges from an orifice and passes outwards over an external director surface of a Coanda body. The present invention uses a Coanda body of type (b). A steam driven flare using a Coanda body of this type is described in our UK patent No. 1381867.

Flares for disposal of combustible gases have two main sources of noise. Firstly there is noise resulting from the combustion of the fuel gas which is generally of low frequency. Also there is noise resulting from the emergence of high velocity steam from its outlet which is generated when steam is used to improve combustion and smoke suppression. This noise is of higher frequency (of the order typically 1 to 4 KHz) than combustion noise and is generally in the form of a sonic whistle.

The present invention is concerned with the provision of shrouds or shields to attenuate the flare noise while at the same time attempting to avoid problems such as excessive flame lick down the flare.

Thus according to the present invention there is provided a flare comprising a supply line for a pressurised gas and a Coanda body positioned over the outlet of the supply line so as to define a high pressure gas outlet adapted to direct the issuing high pressure gas over the outer surface of the Coanda body, and means for reducing the noise of the issuing high pressure gas, said means comprising an upwardly diverging frusto-conical shield surrounding the high pressure gas line.

The noise attenuating shield preferably takes the form of one or more upwardly diverging frusto-conical shields. The shields may be closed or open, i.e. sealing or spaced apart from the flare body.

A preferred embodiment comprises two upwardly diverging frusto-conical shields, the lower shield being closed with the flare body and the upper shield being open. Preferably the lower edge of the upper shield and the upper edge of the lower closed shield overlap each other. This embodiment has the advantage of giving a large accoustic shadow angle whilst enabling substantially normal air entrainment ratios to be maintained by the Coanda body.

Another preferred embodiment comprises a single closed shield.

Preferably the upper edge of the noise attenuating shield is at or below the level of the high pressure gas outlet (or in the case of more than one shield, the upper edge of the highest shield. This condition is desirable to give minimum interference with the high pressure gas flow.

The angle of the shield to the vertical is preferably from 30° to 60° and is most preferably 45°.

The shield is preferably fabricated from austenitic stainless steel or a nickel alloy.

The high pressure gas supply is usually steam or a high pressure fuel gas. If the high pressure gas is steam, and in some cases if the high pressure gas is fuel gas, then the Coanda body includes an internal passage adapted to supply fuel gas at a lower pressure into the flow of high pressure gas and air. In this case, the high pressure gas emerging from the outlet and passing over the outer surface of the Coanda body causes surrounding air to be entrained and to pass towards the outlet of the internal passage to assist the combustion of the lower pressure fuel gas. The high pressure gas outlet is preferably in the form of an annular slot.

In a further embodiment of the invention, the noise attenuation shield comprises (a) a frusto-conical shield surrounding and spaced apart from the high pressure gas outlet and (b) a horizontal shield, preferably in the form of a plate or disc, located below the frusto-conical shield and closed with the flare body.

The arrangement may also be used with flares which have a high pressure gas source but do not employ the Coanda effect, such as steam-driven flares using a ring of steam nozzles surrounding the flame tip and directed upwards and inwards towards the emerging low pressure gas steam. However, in this case the short distance between the shield and the flame can cause damage and even complete burn off of the shield.

The shield may also be fabricated in the form of a sandwich of noise absorbing material. A preferred embodiment is a sandwich of noise absorbing material e.g. kaowool (a registered trade mark) between sheets of stainless steel or a nickel alloy. A typical sandwich thickness would be of the order of 10 cms.

The invention will now be described by way of example only with reference to FIGS. 1 to 4 of the accompanying drawings.

The burner shown comprises a director surface 10 which forms the outer surface of a director body which has a steam outlet 11 at its lower end and a secondary outlet 12 for fuel gas at its upper end. During use the steam flows over the director surface 10 and this flow initiates flow of steam and air towards the secondary fuel gas outlet 12.

The director body has a flat base 13 and the steam outlet 11 takes the form of an annular slot formed between the wall of the steam line 14 and the flat base 13 so that the steam leaves the steam outlet 11 as a thin horizontal sheet.

The director surface 10 comprises two portions, namely a deflector portion 15 which turns the direction of flow of the steam from the horizontal to vertical, and a continuation portion 16 which maintains the flow of steam and air between the deflector portion 15 and the fuel gas outlet 12. The purpose of this curved continuation 16 is to allow a suitable separation between the steam outlet 11 and the secondary outlet 12, while maintaining the skin effect up to the secondary outlet 12.

The shape of the deflector portion 15 is most conveniently specified as the surface of revolution formed by the rotation of a quadrant of a circle about the longitudinal axis of the director body, the curved section of the quadrant being tangential to the steam outlet; as shown in the drawing the distance between the axis of rotation and the centre of the quadrant is several times the radius of the quadrant thus giving rise to a tapered portion.

As the steam flows around the deflector portion 15 its direction of flow is changed from (initially) horizontal to vertical. This induces a low pressure zone in the surrounding air and hence it induces movement of air as well as steam towards the secondary outlet 12.

The fuel is conveyed to the secondary outlet by the fuel gas line 17 (which forms an annular configuration with the steam line 14) and fuel which issues from the fuel line 17 meets the converging stream of steam and air moving over surface 16.

Ignition of the flare is achieved by a pilot light system (not shown) situated adjacent to the top of the Coanda body. The resultant flame would, under normal operating conditions, sit above the secondary outlet 12.

FIGS. 1 to 4 show various types of noise reducing means attached to flarestacks.

In FIG. 1, a closed frusto-conical shield 18 has its top lip 25 mms below the steam outlet 11. The maximum diameter of the shield is 1250 mms. This arrangement proved effective in reducing the high frequency noise level of the steam jet emerging from the outlet 11.

Figure 2:
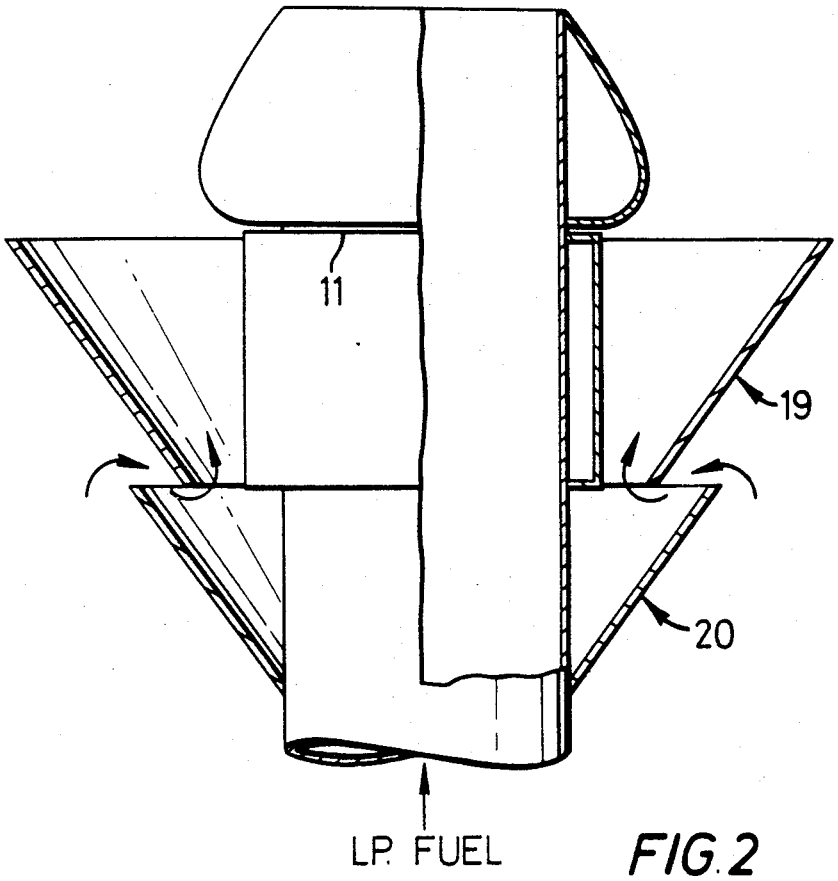

In FIG. 2, the flare has an open frusto-conical noise shield 19 of small diameter 910 mm and large diameter 1250 mm fitted with its top lip 25 mm below the steam outlet 11, and in addition, a closed frusto-conical noise shield 20 of maximum diameter 1080 mm fitted to the flare stack and below shield 19 leaving an average distance of 100 mm between the two shields.

Figure 3:
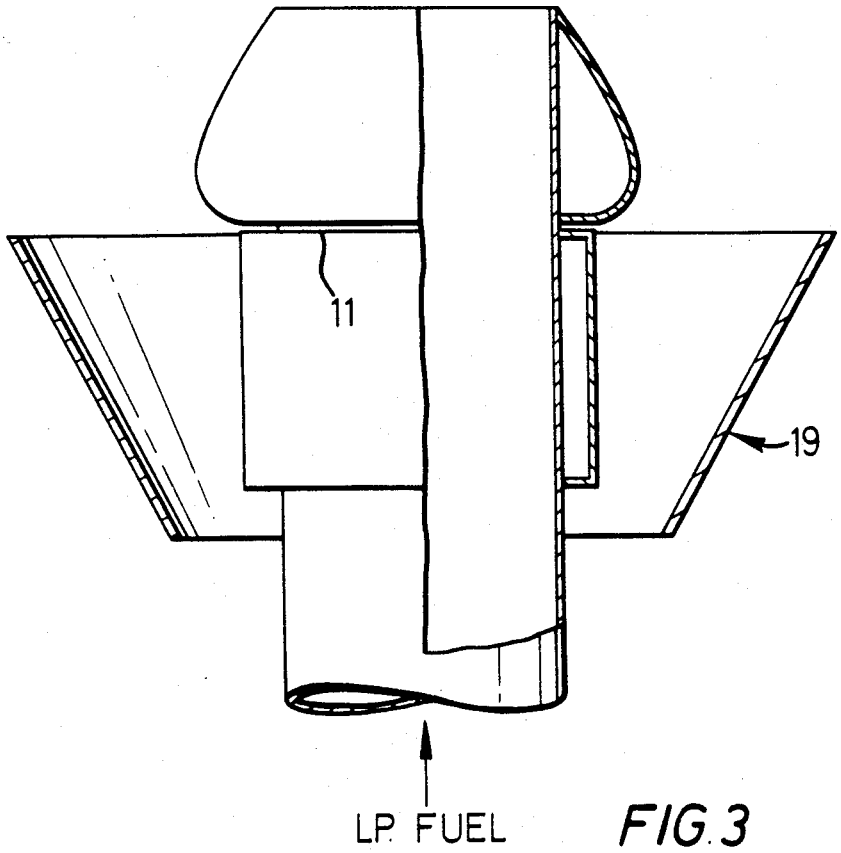

In FIG. 3, the flare has the open frusto-conical noise shield 19 (of FIG. 2) alone.

Figure 4:
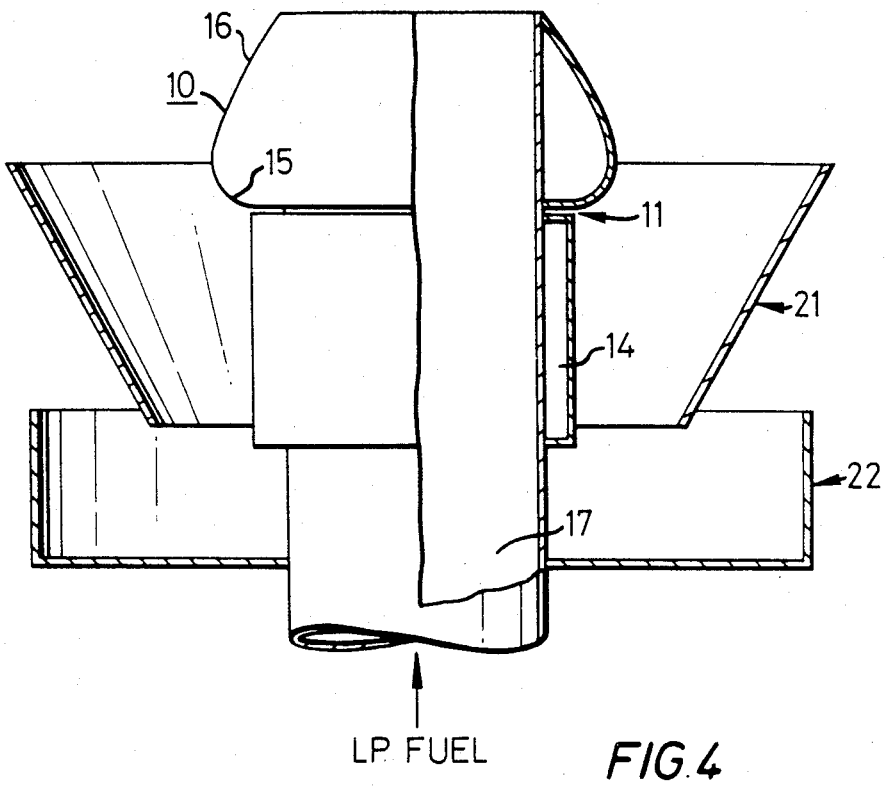

In FIG. 4, the flare has an inner conical shield 21 around the steam outlet 11 having an overall height of 300 mm and maximum and minimum diameters of 750 mm and 580 mm respectively. The clearance between the upper edge of the shield and the Coanda body was about 350 mm. An outer flat shield 22 of diameter 750 mm closed with the flare body and having a vertically projecting side wall 23 of height 150 mm at its outer edge was positioned below the inner conical shield 21.

During trials with a steam driven Coanda flare, the results shown in the table below were obtained. The Coanda flare was of 600 mm internal diameter and mounted on a vertical stack so that the top flare was 5.2 meters above ground level. The noise attenuations were measured at various distances from the stack base (means of four directions).

TABLE

| Snield Type | Distance from stack Base (meters) | Noise Attenuation shield (dBA) |
|---|---|---|
| Type shown in FIG. 1 with | 4.4 | 8.2 |
| top of shield 25 mm below | 10 | 8.0 |
| level of steam exit slot | 20 | 7.5 |
| Type shown in FIG. 2 with | 2.0 | 6.8 |
| top of upper shield 25 mms | 4.4 | 10.3 |
| below level of steam exit | 10 | 8.5 |
| slot. | | |

We claim:

1. A flare comprising a supply line for a pressurized gas and a Coanda body positioned over the outlet of the supply line so as to define a high pressure gas outlet adapted to direct the issuing high pressure gas over the outer surface of the Coanda body, means for reducing the noise of the high pressure gas issuing from the Coanda outlet, the means comprising a first upwardly diverging frusto-conical shield surrounding the pressurized gas line, the lower edge of the first shield being spaced apart from the flare body and a second shield closed with the flare body and located below the first shield.

2. A flare according to claim 1 in which the second shield is upwardly diverging and frusto-conical in shape, the lower edge of the second shield being closed with the flare body and the lower edge of the upper shield being spaced apart from the flare body.

3. A flare according to claim 1 or claim 2 in which the lower edge of the first shield and the upper edge of the second shield overlap each other.

4. A flare according to claim 1 in which the upper edge of the first shield is at or below the level of the high pressure gas outlet.

5. A flare according to claim 1 or claim 2 in which the angle of the upper shield to the vertical is from 30° to 60°.

6. The flare according to claim 1 or 2 in which the angle of the upper shield to the vertical is 45°.

7. A flare according to claim 1 in which a horizontal shield is located below the first upwardly diverging frusto-conical shield and closed with the flare body.

8. A flare according to claim 1 in which the high pressure gas is steam.

9. A flare according to claim 1 in which the Coanda body has an internal passage adapted to supply fuel gas at a lower pressure into the flow of high pressure gas and air.

10. A flare according to claim 1 in which the shield is fabricated from austenitic stainless steel or nickel alloys.

11. A flare according to claim 1 in which the shield comprises a sandwich of noise absorbing material.

12. A flare according to claim 11 in which the sandwich comprises a noise absorbing material between sheets of stainless steel or a nickel alloy.

13. A flare according to claim 1 in which flare ignition means are located near to the top of the Coanda body.

* * * * *